US007345642B2

(12) United States Patent
Cohen

(10) Patent No.: US 7,345,642 B2
(45) **Date of Patent: *Mar. 18, 2008**

(54) ANTENNA SYSTEM FOR RADIO FREQUENCY IDENTIFICATION

(75) Inventor: Nathan Cohen, Belmont, MA (US)

(73) Assignee: Fractal Antenna Systems, Inc., Bedford, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/327,982

(22) Filed: Jan. 9, 2006

(65) Prior Publication Data

US 2006/0119520 A1 Jun. 8, 2006

Related U.S. Application Data

(63) Continuation of application No. 10/971,815, filed on Oct. 22, 2004, now Pat. No. 6,985,122.

(60) Provisional application No. 60/513,497, filed on Oct. 22, 2003.

(51) Int. Cl.
*H01Q 9/16* (2006.01)
*H01Q 1/36* (2006.01)

(52) U.S. Cl. ..... 343/793; 343/795; 343/792.5; 343/895; 343/700 MS

(58) Field of Classification Search ..... 343/793, 343/795, 700 MS, 895, 767, 770
See application file for complete search history.

(56) References Cited

U.S. PATENT DOCUMENTS

| | | | | |
|---|---|---|---|---|
| 6,362,796 | B1 * | 3/2002 | Bohlman | 343/895 |
| 6,452,553 | B1 * | 9/2002 | Cohen | 343/702 |
| 6,525,691 | B2 * | 2/2003 | Varadan et al. | 343/700 MS |
| 6,985,122 | B2 * | 1/2006 | Cohen | 343/793 |
| 2002/0175874 | A1 * | 11/2002 | Eason | 343/770 |
| 2003/0112196 | A1 * | 6/2003 | Wang et al. | 343/767 |
| 2003/0122713 | A1 * | 7/2003 | Morris et al. | 343/700 MS |
| 2003/0160723 | A1 * | 8/2003 | Cohen | 343/700 MS |
| 2004/0164904 | A1 * | 8/2004 | Tran | 343/700 MS |

* cited by examiner

*Primary Examiner*—Trinh Vo Dinh
(74) *Attorney, Agent, or Firm*—McDermott Will & Emery, LLP

(57) ABSTRACT

An antenna including an electrically conductive portion defined substantially by a self-similar geometry present at multiple resolutions. The electrically conductive portion includes two or more angular bends and is configured to radiate broadband electromagnetic energy. The antenna further includes an electrically non-conductive portion that structurally supports the electrically conductive portion.

18 Claims, 4 Drawing Sheets

ANTENNA SYSTEM FOR RADIO FREQUENCY IDENTIFICATION

RELATED APPLICATIONS AND TECHNICAL FIELD

This application is a continuation of U.S. patent application Ser. No. 10/971,815, filed Oct. 22, 2004, now U.S. Pat. No. 6,985,122 which claimed priority to U.S. Provisional Patent Application Ser. No. 60/513,497, filed Oct. 22, 2003, both of which applications are incorporated in their entireties herein by reference.

This disclosure relates to antenna systems and, more particularly, to an antenna system for radio frequency identification (RFID).

BACKGROUND

Antennas are used to radiate and/or receive typically electromagnetic signals, preferably with antenna gain, directivity, and efficiency. Practical antenna design traditionally involves trade-offs between various parameters, including antenna gain, size, efficiency, and bandwidth.

Antenna design has historically been dominated by Euclidean geometry. In such designs, the closed area of the antenna is directly proportional to the antenna perimeter. For example, if one doubles the length of an Euclidean square (or "quad") antenna, the enclosed area of the antenna quadruples. Classical antenna design has dealt with planes, circles, triangles, squares, ellipses, rectangles, hemispheres, paraboloids, and the like.

With respect to antennas, prior art design philosophy has been to pick a Euclidean geometric construction, e.g., a quad, and to explore its radiation characteristics, especially with emphasis on frequency resonance and power patterns. Unfortunately antenna design has concentrated on the ease of antenna construction, rather than on the underlying electromagnetics, which can cause a reduction in antenna performance.

This reduced antenna performance is evident in systems such as radio frequency identification (RFID) systems. RFID systems are used to track and monitor a variety of objects that range from commercial products and vehicles to even individual people. To track and monitor these objects an antenna and a radio frequency (RF) transceiver (together known as an RFID tag) are attached to the object. When an RF signal (usually transmitted from a handheld RF scanning device) is received by the RFID tag, the RF signal is used to transmit back another RF signal that contains information that identifies the object. However, an RFID tag's performance of can be affected by the environment in which it is placed. For example, performance of an antenna included in an RFID tag may be degraded by the object (e.g., a metallic shipping container, a car, etc.) to which it is attached. Due to this degradation, the RFID tag may need to be scanned multiple times and at a close range in order to activate the tag.

SUMMARY OF THE DISCLOSURE

In accordance with an aspect of the disclosure, an antenna includes an electrically conductive portion defined substantially by a self-similar geometry present at multiple resolutions. The electrically conductive portion includes two or more angular bends and is configured to radiate broadband electromagnetic energy. The antenna further includes an electrically non-conductive portion that structurally supports the electrically conductive portion.

In a preferred embodiment, the electrically conductive portion may include an element defined substantially by a V-shaped geometry or defined substantially by a rectangular geometry. The geometry of self-similarity at multiple resolutions may include a deterministic fractal.

In accordance with another aspect, a radio frequency identification system includes an antenna having an electrically conductive portion defined substantially by a self-similar geometry present at multiple resolutions. The electrically conductive portion includes two or more angular bends and is configured to radiate broadband electromagnetic energy. Further, the antenna includes an electrically non-conductive portion that structurally supports the electrically conductive portion. The radio frequency identification system further includes an integrated circuit in communication with the antenna, wherein the integrated circuit is configured to respond to an electromagnetic signal received by the antenna.

In one embodiment of the system, the broadband electromagnetic energy may radiate within a 10:1 ratio or a 50:1 frequency band. The antenna may includes a dipole geometry or a monopole geometry.

Additional advantages and aspects of the present disclosure will become readily apparent to those skilled in the art from the following detailed description, wherein embodiments of the present invention are shown and described, simply by way of illustration of the best mode contemplated for practicing the present invention. As will be described, the present disclosure is capable of other and different embodiments, and its several details are susceptible of modification in various obvious respects, all without departing from the spirit of the present disclosure. Accordingly, the drawings and description are to be regarded as illustrative in nature, and not as limitative.

DETAILED DESCRIPTION OF THE PREFERRED EMBODIMENTS

Figure 1:
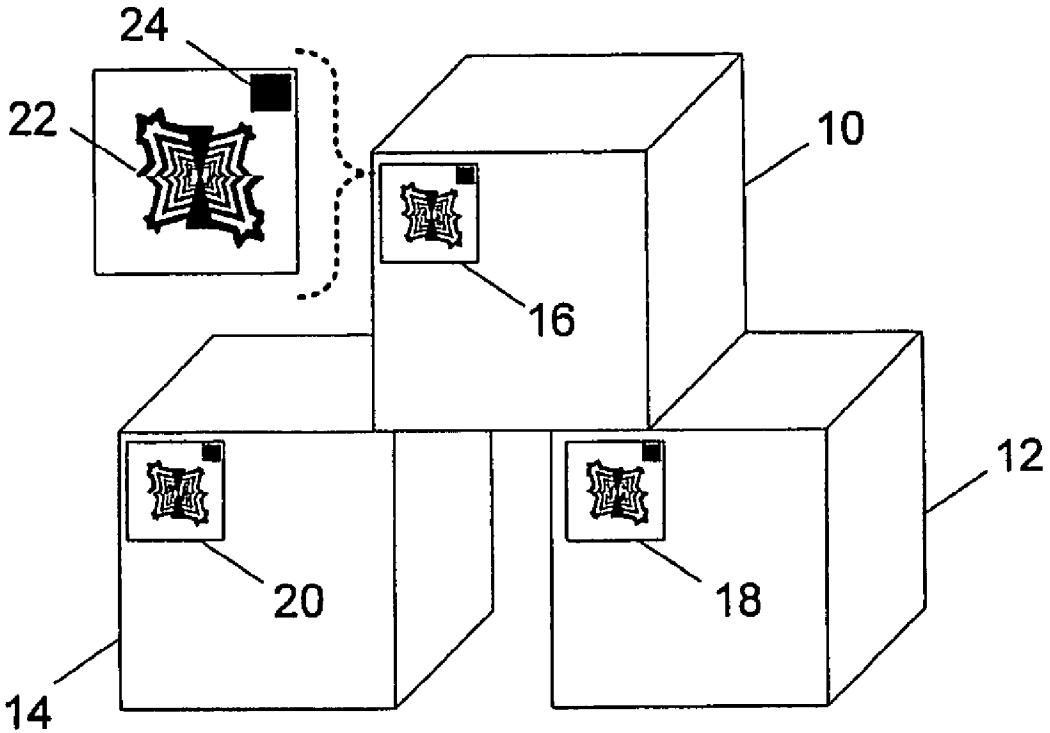
FIG. 1 is a diagram depicting RFID tags attached to a group of containers.

Referring to FIG. 1, a stack of shipping containers 10-14 are individually attached with RFID tags 16-20 so that each container can be tracked and monitored as it transits from one location (e.g., a warehouse, loading dock, stock yard, etc.) to a destination location (e.g., a retail store, personal residence, etc.). Each of the RFID tags, such as RFID tag 16 includes a surface-mounted antenna 22 that is capable of transmitting and receiving electromagnetic signals to and from an RFID scanner. Typically, an RFID scanner is used by personnel to check the identification of the containers such as container 10. In this example, RFID tags 16-20 are mounted to containers, however, in other arrangements tags may be mounted on and used to track other commercial or private objects and in some applications living bodies such as animals and humans. Furthermore, while RFID tags 16-20 are surface-mounted onto shipping contains 10-14, in other examples, each tags may extend off the container surface. For example, an RFID tag may be placed inside a rod or within another type of three-dimensional object that is attached to the container. An integrated circuit 24 may be present for communication with the antenna 22. The integrated circuit 24 may be configured to respond to an electromagnetic signal received by the antenna 22.

Figure 2:
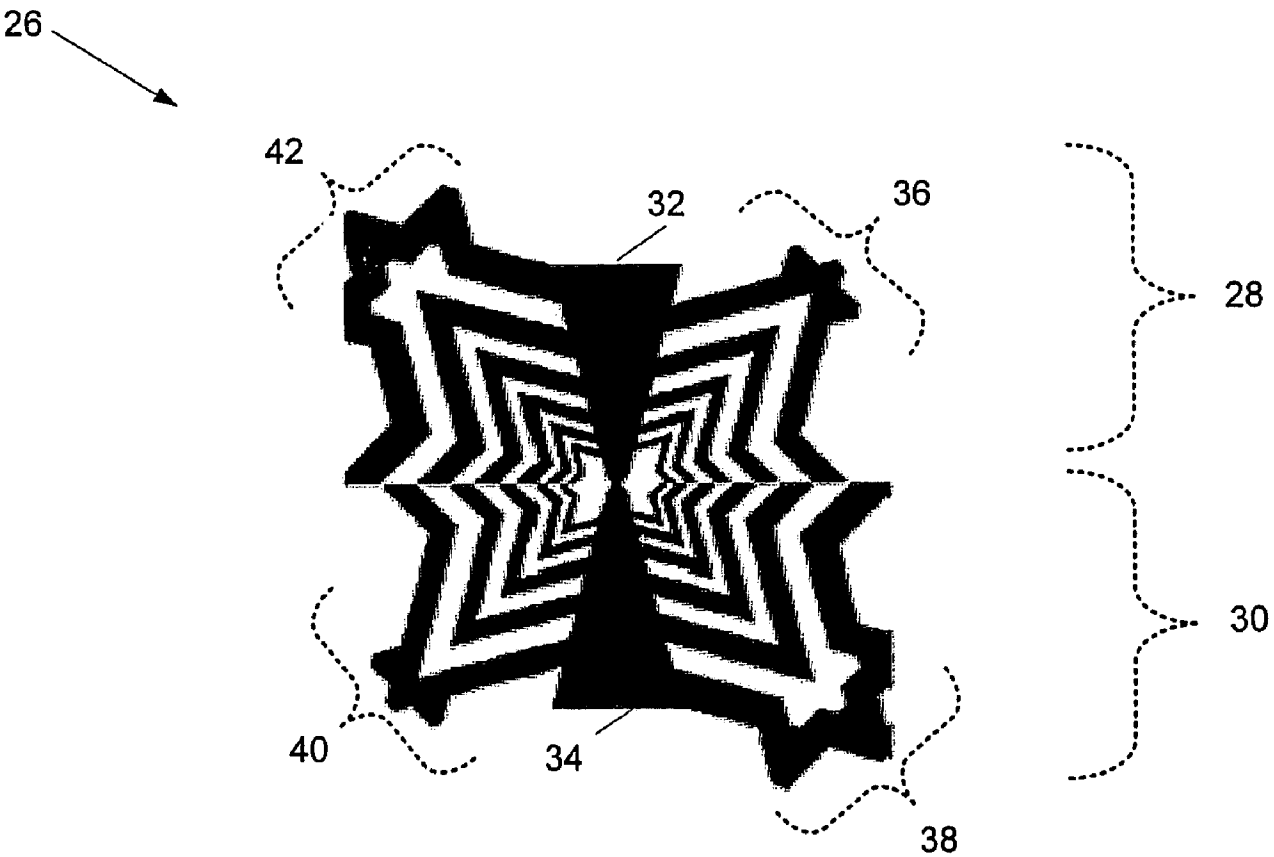
FIG. 2 is one embodiment of a wide band dipole antenna for use in an RFID tag.

Referring to FIG. 2, antenna 26 is a dipole antenna that includes an upper portion 28 and a lower portion 30. To radiate and receive electromagnetic energy, antenna 26 includes conductive material that is represented by the color black and non-conductive material that is represented by the color white. Typical conductive materials that may be used to produce antenna 26 include metal, metallic paint, metallic ink, metallic film, and other similar materials that are capable of conducting electricity. Non-conductive materials may include insulators (e.g., air, etc.), dielectrics (e.g., glass, fiberglass, plastics, etc.), semiconductors, and other materials that impede the flow of electricity. Along with impeding current flow, the non-conductive material also typically provides structural support to the conductive portion of antenna 26. So, to provide such support, the non-conductive materials may include materials typically used for support (e.g., wood, plastic, etc.) that is covered by a non-conductive material on its outer surface.

In this embodiment, antenna 26 includes two traces 32, 34 of conductive material that are each triangular in shape and are positioned to mirror each other in orientation. Each portion 28, 30 of antenna 26 also includes series of traces 36-42 that extend radially from the center of the antenna and define an outer boundary. Each trace series 36-42 includes both conductive traces and non-conductive segments (between each pair of conductive traces) as represented by the black and white colors.

Focusing on trace series 36, the shape of each conductive trace and non-conductive segment are similar and include multiple bends. In particular each trace and segment is self-similar in shape and is similar at all resolutions. In general the self-similar shape is defined as a fractal geometry. Fractal geometry may be grouped into random fractals, which are also termed chaotic or Brownian fractal and include a random noise components, or deterministic fractals. Fractals typically have a statistical self-similarity at all resolutions and are generated by an infinitely recursive process. For example, a so-called Koch fractal may be produced with N iterations (e.g., N=1, N=2, etc.). However, in other arrangements trace series 36 may be produced using one or more other types of fractal geometries.

Along with extending the frequency coverage of antenna 26 for broadband operations, by incorporating a fractal geometry to increase conductive trace length and width, antenna losses are reduced. By reducing antenna loss, the output impedance of antenna 26 is held to a nearly constant value across the operating range of the antenna. For example, a 50-ohm output impedance may be provided by antenna 26 across a frequency band with a 10:1 or 50:1 ratio.

In this arrangement, when antenna 26 is transmitting an electromagnetic signal (in response to receiving an electromagnetic signal from a scanner), conductive traces 32, 34 primarily radiate the signal while the series of traces 36-42 load the antenna. By radiating and loading appropriately, both portions 28, 30 cause antenna 22 to produce a dipole beam pattern response.

Figure 3:
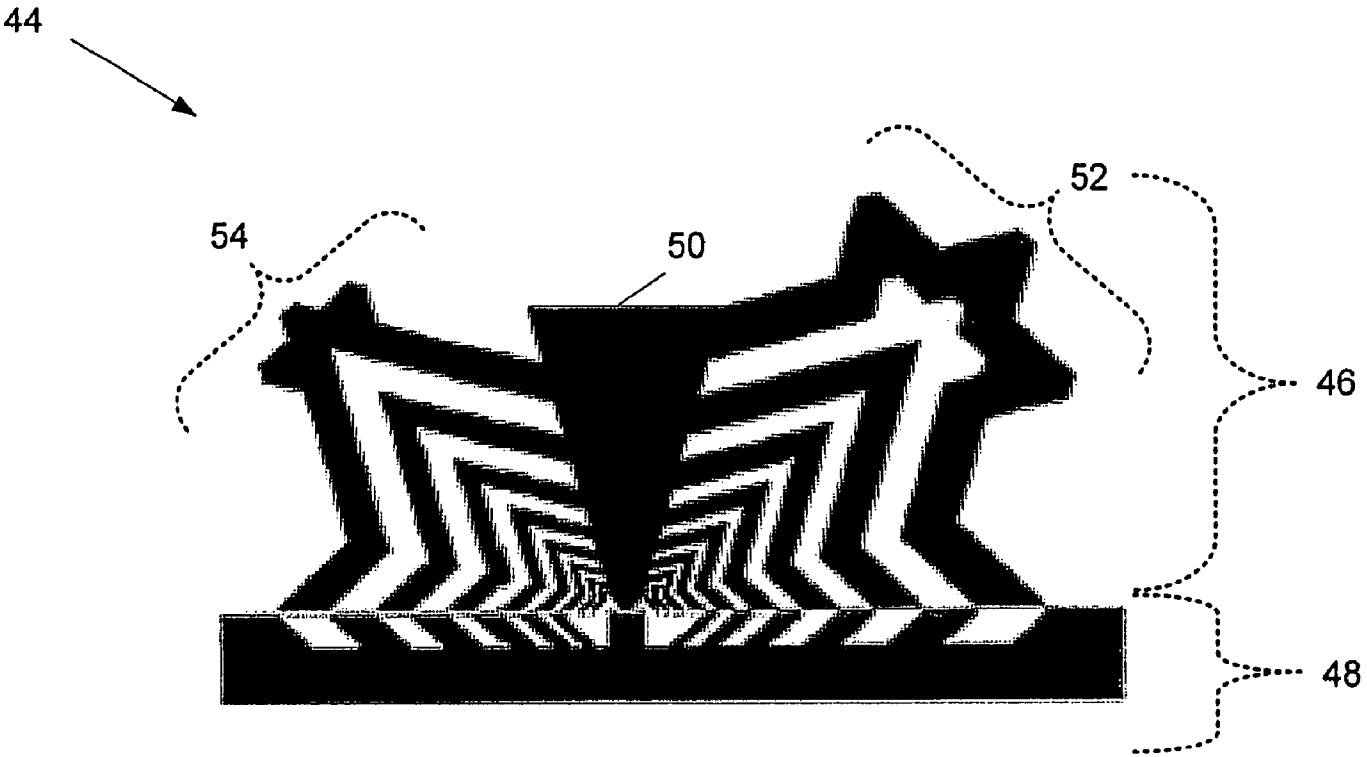
FIG. 3 is one embodiment of a wide band monopole antenna for use in an RFID tag.

Referring to FIG. 3, an antenna 44 is presented in which again conductive material is represented with the color black and non-conductive material is represented with the color white. Antenna 44 includes an upper portion 46 that is similar to the upper portion 28 of antenna 26. However, to provide a monopole antenna response, antenna 44 includes a lower portion 48 that simulates a ground plane. Similar to antenna 26, both upper and lower portions 46, 48 include conductive and non-conductive material. In particular, a V-shaped conductive trace 50 is included in upper portion 46 along with two series 52, 54 of conductive traces and non-conductive segments that radially extend from the intersection of the tip of V-shaped conductive trace 50 and lower portion 48. Similar to antenna 26, each series of traces and segments 52, 54 incorporate a self-similar geometry (e.g., a fractal) that is present at all resolutions of each trace. Each trace and segment in both series 52, 54 include multiple bends as part of the fractal geometry to increase the length and width of each trace and segment while not expanding the footprint area of antenna 44. By incorporating this geometry and the multiple bends, antenna 44 is capable of operating over a broad frequency band (e.g., such as the ranges associated with antenna 26) while providing a nearly constant impedance (e.g., 50-ohms).

Figure 4:
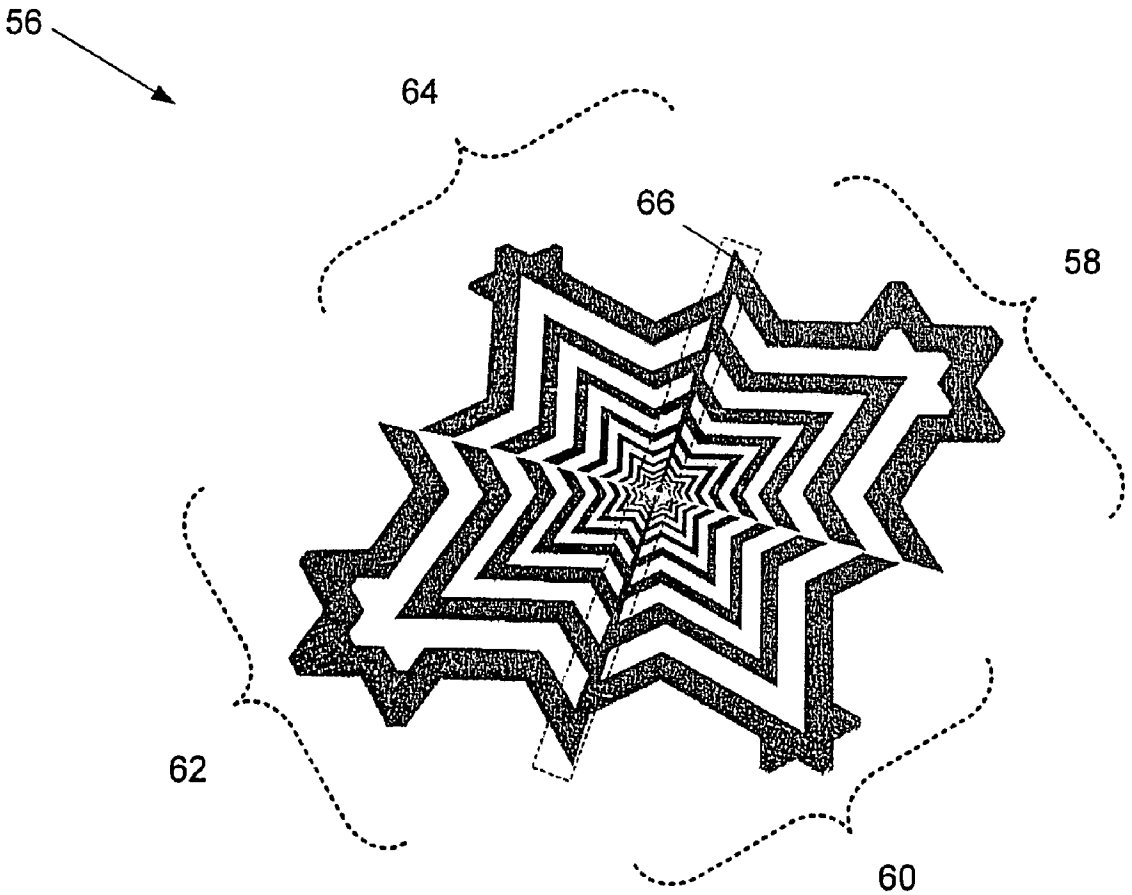
FIG. 4 is another embodiment of a wide band dipole antenna for use in an RFID tag.

Referring to FIG. 4, an antenna 56, which is similar to the previous examples, includes conductive material that is represented with a dark color and non-conductive material that is represented with the color "white". Antenna 56 includes four portions 58-64, each incorporating a similar fractal pattern that was included in antenna 26 and antenna 44. However, rather than a V-shaped conductive trace, antenna 56 includes a nearly rectangular-shaped conductive trace 66 (highlighted by a dashed-line box) that extends from one end of the antenna, through the center of the antenna, and to the opposite end of the antenna. The rectangular-shaped conductive trace 66 has a relatively thin width and is relatively long in length. Due to this geometry, trace 66 provides a loading effect on antenna 56 rather than predominately providing the function of radiating electromagnetic energy, which was provided by the V-shaped traces 32, 34 and 50. When antenna 56 is put into a transmission mode, the extended lengths and widths of the conductive traces in the four portions 58-64 allow antenna 56 radiate the electromagnetic energy across a broad frequency band. Similarly, due to the fractal geometry incorporated into portions 58-64, the RFID tag is capable of receiving an electromagnetic signal across a broad frequency band.

A number of implementations have been described. Nevertheless, it will be understood that various modifications may be made. Accordingly, other implementations are within the scope of the following claims.

What is claimed is:

1. An antenna comprising:

first and second electrically conductive portions defined substantially by a self-similar geometry present at multiple resolutions, each electrically conductive portions include first and second portions, wherein the first and second portions of each electrically conductive portion are substantially mirror images of the first and second portions of the other electrically conductive portion, wherein each of the first and second portions consists of a trace and has two and more angular bends, and each bend has a distal end and a proximal end, wherein in each electrically conductive portion, the proximal ends are connected to the trace, and the distal ends of the first electrically conductive portion abut the distal ends of second electrically conductive portion along a line dividing the first and second electrically conductive portions, and wherein the distal ends of the first and second electrically conductive portions are offset from one another along the line by a distance substantially equal to the thickness of the corresponding angular bend, forming a closed pattern, wherein the electrically conductive portions are configured to radiate broadband electromagnetic energy; and an electrically non-conductive portion that structurally supports the electrically conductive portion.

2. The antenna of claim 1, wherein the electrically conductive portions include an element defined substantially by a V-shaped geometry.

3. The antenna of claim 1, wherein the electrically conductive portions include an element defined substantially by a rectangular geometry.

4. The antenna of claim 1, wherein the geometry of self-similarity at multiple resolutions includes a deterministic fractal.

5. The antenna of claim 1, wherein the broadband electromagnetic energy radiates substantially within a 10:1 ratio frequency band.

6. The antenna of claim 1, wherein the broadband electromagnetic energy radiates substantially within a 50:1 ratio frequency band.

7. The antenna of claim 1, wherein the broadband electromagnetic energy radiates between 400 MHz and 6000 MHz.

8. The antenna of claim 1, wherein the electrically conductive portions include a ground plane.

9. The antenna of claim 1, wherein the conductive material is metallic.

10. A radio frequency identification system comprising:

an antenna including, first and second electrically conductive portions defined substantially by a self-similar geometry present at multiple resolutions, each electrically conductive portions include first and second portions, wherein the first and second portions of each electrically conductive portion are substantially mirror images of the first and second portions of the other electrically conductive portion, wherein each of the first and second portions consists of a trace and has two and more angular bends, and each bend has a distal end and a proximal end; wherein in each electrically conductive portion, the proximal ends are connected to the trace, and the distal ends of the first electrically conductive portion abut the distal ends of second electrically conductive portion along a line dividing the first and second electrically conductive portions, and wherein the distal ends of the first and second electrically conductive portions are offset from one another along the line by a distance substantially equal to the thickness of the corresponding angular bend, forming a closed pattern, wherein the electrically conductive portions are configured to radiate broadband electromagnetic energy, and an electrically non-conductive portion that structurally supports the electrically conductive portion; and an integrated circuit in communication with the antenna, wherein the integrated circuit is configured to respond to an electromagnetic signal received by the antenna.

11. The radio frequency identification system of claim 10, wherein the broadband electromagnetic energy radiates within a 10:1 ratio frequency band.

12. The radio frequency identification system of claim 10, wherein the broadband electromagnetic energy radiates within a 50:1 ratio frequency band.

13. The radio frequency identification system of claim 10, wherein the antenna includes a dipole geometry.

14. The radio frequency identification system of claim 10, wherein the antenna includes a monopole geometry.

15. The radio frequency identification system of claim 10, wherein the antenna is surface mounted.

16. The radio frequency identification system of claim 10, wherein the electrically non-conductive portions include a dielectric material.

17. The radio frequency identification system of claim 10, wherein the antenna is configured to provide a substantially constant output impedance across a broad frequency band.

18. The radio frequency identification system of claim 10 wherein the integrated circuit is configured to initiate transmitting of an electromagnetic signal at the antenna.

* * * * *